US007022188B2

(12) United States Patent
Ganci

(10) Patent No.: US 7,022,188 B2
(45) Date of Patent: Apr. 4, 2006

(54) METHOD AND DEVICE FOR MASKING PART OF A VEHICLE

(75) Inventor: Eric Marc Ganci, Marrakech (MA)

(73) Assignees: Denis A. Zebine, Marrakech (MA); Eric M. Ganci, Marrakech (MA)

( * ) Notice: Subject to any disclaimer, the term of this patent is extended or adjusted under 35 U.S.C. 154(b) by 0 days.

(21) Appl. No.: 10/398,429

(22) PCT Filed: Oct. 3, 2001

(86) PCT No.: PCT/FR01/03044

§ 371 (c)(1),
(2), (4) Date: Apr. 4, 2003

(87) PCT Pub. No.: WO02/29767

PCT Pub. Date: Apr. 11, 2002

(65) Prior Publication Data

US 2004/0086679 A1 May 6, 2004

(30) Foreign Application Priority Data

Oct. 5, 2000 (FR) ..... 00 12751
Aug. 27, 2001 (FR) ..... 01 11145

(51) Int. Cl.
*B05C 21/00* (2006.01)

(52) U.S. Cl. ..... 118/504; 118/505; 428/58; 428/131

(58) Field of Classification Search ..... 118/504, 118/505; 428/58, 131; 427/282
See application file for complete search history.

(56) References Cited

U.S. PATENT DOCUMENTS

| | | | | |
|---|---|---|---|---|
| 2,239,040 A | | 4/1941 | Holmes | |
| 2,371,859 A | | 3/1945 | Wallace | |
| 2,979,840 A | | 3/1961 | Eastman | |
| 3,752,304 A | | 8/1973 | Alef | |
| 4,117,199 A | * | 9/1978 | Gotoh et al. | 428/486 |
| 4,420,520 A | | 12/1983 | Jones et al. | |
| 4,572,761 A | | 2/1986 | Phillips | |
| 4,646,364 A | | 3/1987 | O'Larey | |
| 4,659,595 A | * | 4/1987 | Walker et al. | 427/391 |
| 4,802,692 A | | 2/1989 | Stryd | |
| 5,150,726 A | | 9/1992 | Rucker | |
| 5,205,454 A | | 4/1993 | Schutz | |
| 5,562,964 A | | 10/1996 | Jones | |
| 5,631,055 A | | 5/1997 | Vines et al. | |
| 5,649,631 A | | 7/1997 | Loflin | |
| 5,894,923 A | | 4/1999 | Hamstra et al. | |

FOREIGN PATENT DOCUMENTS

| | | |
|---|---|---|
| DE | 87 09 562 | 10/1987 |
| EP | 0 334 360 | 9/1989 |
| GB | 2 265 404 | 9/1993 |

* cited by examiner

*Primary Examiner*—Laura Edwards
(74) *Attorney, Agent, or Firm*—Cohen, Pontani, Lieberman & Pavane

(57) ABSTRACT

The present invention relates to a mask for protecting a convex and/or window portion of a vehicle, the mask being made of a sheet material, and having an outline that is curvilinear, at least in part. A device for masking convex and/or window portions of motor vehicles is also provided having a plurality of masks that are united to form a packet of masks.

10 Claims, 9 Drawing Sheets

110

METHOD AND DEVICE FOR MASKING PART OF A VEHICLE

This application is a U.S. National Phase Application under 35 USC 371 of International Application PCT/FR01/03044 (not published in English) filed Oct. 3, 2001 which claims priority from the following application(s): Country: France, Application No.: 00/12751, Filed: 05 Oct. 2000; Country: France, Application No.: 01/11145, Filed: 27 Aug. 2001.

BACKGROUND OF THE INVENTION

The present invention relates to a method and to apparatus for masking a portion of a motor vehicle, in order to protect said portion from the dirtying that can result from painting some other portion of the vehicle.

The technical field of the invention is that of repairing motor vehicle bodywork.

It is known to protect the windows of a motor vehicle prior to painting at least a portion of its bodywork by means of masks that cover said windows. The term "window" is used essentially to cover the non-painted portions of the vehicle, in particular the windshields, the back window, the left and right side windows, the headlight units, the rear light units, the outside mirrors, and other parts such as wheels, hubcaps, or bumpers.

To perform this masking operation, also known as "papering", it is common practice to use paper dispensed from a roll; for each member that needs to be protected, the operator cuts and/or tears a sheet of paper by hand; the width of the sheet is the width of the selected roll of paper, and the length of the sheet is determined approximately by the operator as a function of the dimensions of the member that is to be protected; the sheet thus presents two first edges that are parallel and rectilinear, and two second edges that are of a shape and orientation that are the result of the cutting technique used; under no circumstances does the shape of the sheet as formed in this way correspond to the shape of the member that is to be protected; the operator needs subsequently to tear and/or crumple the sheet so as to match its outline approximately to that of the member that is to be protected; these operations are lengthy and difficult, and the resulting sheet never matches exactly the shape of the part that is to be protected.

In the construction industry, U.S. Pat. No. 3,752,304 discloses the idea which consists in using triangular masks for covering a rectangular glazed area of a window by means of two adjacent masks that overlap; pairs of identical masks are grouped together to form rectangles; the masks make up a roll provided with transverse perforations in order to enable rectangular sheets to be prepared manually; that document gives no indication about the appropriate sheet material.

In the automobile industry, it is known to use masks of shape matching the shape of a portion of a vehicle in order to protect said portion during an operation of painting some other portion of the vehicle.

U.S. Pat. No. 2,371,859 describes a flexible masking device which is constituted by a strip of rubber and a flexible cloth covering which is spread over the portion of bodywork that is to be protected, being fixed to and suspended from the strip of rubber; that strip is sufficiently flexible to be applied to surfaces that present corners and irregular outlines; it has a series of cavities forming suction cups to enable the strip to be secured to the bodywork by suction so that no adhesive is needed. Although that devices presents advantages, it is not adapted to enabling a window portion of a motor vehicle to be masked quickly and accurately at low cost.

Document EP 0 334 360 describes multilayer structures for masking a portion of the bottom face of a vehicle, the structures comprising a layer of plastics material foam, a layer of adhesive coating one face of the layer of foam, and a peel-off protective sheet covering the layer of adhesive; discontinuous lines of cut constituted by grooves or perforations are provided so as to enable a portion of said structure to be cut off manually so as to form a mask constituted by one or more individual masks each defined by said lines. It will be understood that such a system makes it possible to obtain a mask presenting a shape that matches very approximately the shape of a portion of a vehicle that needs to be protected; such a structure is capable of being fitted properly only to a portion of a vehicle whose shape matches that of an individual mask or a plurality of juxtaposed individual masks; such a sheet therefore does not make it possible to match accurately the outline of a window portion of a vehicle.

An object of the invention is to provide papering masks, their method of manufacture, and their method of use, which are improved and which remedy, at least in part, the drawbacks of known papering methods and devices.

SUMMARY OF THE INVENTION

The present invention provides masks for protecting window portions of motor vehicles, in particular vehicles for road, air, or rail transport, which masks are adapted to protecting individually and on demand any window portion of any vehicle.

In a first aspect, the invention consists in providing a mask for protecting a convex or window portion of a vehicle, the mask being made of a sheet material whose outline is curvilinear, at least in part and generally completely, in particular in the form of a curvilinear polygon, such that the outline of the mask can match accurately the outline of said portion after the mask has been deformed by being pressed against said portion of the vehicle.

In order to facilitate this deformation during which the mask passes from a configuration which is substantially plane to a (skew) three-dimensional configuration that is generally complex, said sheet material constituting the mask is thin and lightweight; preferably the thickness of this material (reference 119, FIG. 14) is less than 200 microns (μm), and in particular it lies in the range 20 μm to 80 μm; the weight per unit area of this material is preferably less than 200 grams per square meter ($g/m^2$), in particular lying in the range 20 $g/m^2$ to 80 $g/m^2$, and more preferably in the range 30 $g/m^2$ to 60 $g/m^2$, in particular being close to 40 $g/m^2$ to 45 $g/m^2$.

Said material is preferably a single layer without adhesive.

In order to avoid the mask deforming or deteriorating while it is in contact with aqueous or oily substances, it is preferable to use a material in which both faces present high resistance to penetration of such substances; for this purpose, in a preferred embodiment, the paper that is selected is imitation parchment (greaseproof) on both faces or Kraft paper coated in polyethylene on both faces.

Alternatively, the mask may be made, e.g. by thermoforming, out of a plastics material that withstands the solvents used for painting the vehicle.

In order to make a mask easier for an operator to handle, and also in order to facilitate packaging, transport, and storage of a plurality of masks, the mask is preferably extended (bordered by) a strip (or margin) of said sheet material running along one of its curvilinear sides, the outline thereof preferably presenting a rectilinear portion.

This strip enables the mask to which it is connected to be handled without touching the mask and thus without risk of damaging it.

Furthermore, such a strip makes it easier to secure a plurality of masks together by bonding together strips associated with each of the masks respectively; for this purpose, a plurality of masks with their associated strips can be stacked so that the strips overlie completely or in part, and then the strips can be bonded together, by stapling or by adhesive; in addition, or in the alternative, the strips may be pierced by one or more orifices spaced apart at a predetermined distance and of diameter suitable for passing a rod acting as a mask support; a plurality of masks can thus be stored suspended from such a support via their respective strips.

Alternatively, the masks may be stored flat in a cabinet presenting a plurality of compartments which are superposed on one another.

In this case in particular, the rectilinear portion of the outline of the strip encourages compact and ordered storage of a plurality of stacked masks, with the said portion acting as an abutment when the masks are put into a compartment of the cabinet; similarly, said rectilinear portion makes it easy to achieve an ordered and tidy stack of a plurality of masks of different shapes; this makes it easier to package a plurality of masks in a flexible bag (e.g. of plastics material).

The curved line separating a mask from the associated strip is preferably weakened by the presence of perforations or cutouts so that it is easy to separate the mask from the strip extending it.

In order to avoid damaging a mask while it is being transported, stored, or handled, it may be folded in two along a fold line substantially in its middle, or it may be folded concertina-wise along a plurality of lines that are parallel to one another and substantially orthogonal to the long direction of the mask; this also makes it easier to package and store masks of large dimensions, such as masks for protecting a windshield or a vehicle rear window, in particular.

A particular result of the invention is to provide a packet containing a plurality of masks for single use, each of which is preferably extended by at least one extender portion, such as a strip, of the same sheet material as constitutes the mask, and having connection means for enabling said masks to be connected together, said plurality of masks serving to hide a plurality of distinct window portions of a vehicle or of a plurality of identical vehicles.

Thus, in order to be able to protect the window portions of a given range of vehicle models, it is appropriate to have available as many different kinds of packet as there are different models in said range.

Said connection means may comprise staples or adhesive bonding said masks together via their said extender portions, and/or a flexible bag covering said masks together with their associated extender portions; alternatively, the masks may be connected together via their associated extender portions (or strips) so as to form a continuous strip comprising a plurality of masks, with the strip being rolled up to form a roll or else folded zigzag to form a stack.

The invention has the particular advantage of making it possible in a bodywork repair shop to have a large quantity of masks of different shapes available in a compact volume so as to enable one or more convex window portions of any model of vehicle to be masked quickly and accurately, individually and on demand.

In another aspect, the present invention proposes a strip of paper which is preferably wound onto a tubular core to form a roll, with a plurality of masks of identical shape adapted to the shape of a window portion of a determined vehicle being partially cut out in the rolled-up strip which also includes a plurality of first weakened connection portions (i.e. portions of reduced strength) extending between (and/or separating) two adjacent masks of said strip, thereby making it easier to separate masks while avoiding unwanted tearing of the strip.

Alternatively, the paper strip may be folded in a zigzag configuration like computer printout paper.

In the meaning of the present application, the term "paper" covers not only paper, but any non-metallic sheet material, in particular plastics materials and laminated materials.

In order to increase the mechanical strength of the strip of paper, the paper may include at least one detachable side margin which extends continuously along one of its edges, and which is separated from said masks by a second weakened portion (i.e. of reduced strength) so as to make it easier to separate the margin from said masks.

In a preferred embodiment, the strip of paper has two continuous detachable side margins which extend along respective ones of its longitudinal edges.

In a preferred alternative embodiment, one or other or both of the two detachable side margins is/are discontinuous; under such circumstances, the outline of each mask includes a portion that is flush along at least one of the edges of the strip of paper, i.e. extends tangentially thereto, thereby contributing to avoiding pointless scrap paper.

In order to limit the amount of such scrap paper, said first weakened connecting portions between two masks are of a width that is very small compared with the dimensions of the mask: the ratio of said width to the mean dimension of a mask is preferably less than or equal to $10^{-1}$; this ratio may be as little as $10^{-2}$, $10^{-3}$, or $10^{-4}$, and in certain applications its value may even be zero when the outlines of two adjacent masks are placed tangentially to each other.

The ratio of the width of each of said side margins to said mean dimension of the mask is preferably situated in the same range of values as those given above for said connection portions; the term "mean dimension" of a mask is used to mean its equivalent diameter (D) which is calculated by the formula $D=\sqrt{(4S/\pi)}$, where S is the surface area of the mask.

In order to limit scrap paper and/or in order to limit the width of said first weakened connection portions, said masks may be placed opposite ways round in pairs.

In a preferred embodiment, the strip of paper has a single plurality of identical masks; in a preferred variant, the strip may have at least two pluralities of masks: a first plurality of first identical masks (e.g. of shape matching the shape of a front side window of a given vehicle), and a second plurality of second identical masks (e.g. of shape matching that of the rear side window of said vehicle), which second masks are of a shape that is different from that of said first masks.

Under such circumstances, said first masks alternate with said second masks along the strip of paper.

The weakening of the connection portions and/or of the margins can be obtained by perforating or by discontinuously cutting the strip of paper along a line of weakness which may extend along at least a portion of the outline of the mask, and which may be rectilinear or curvilinear, transverse, longitudinal, or oblique.

In order to limit the number of strips of paper needed for masking all of the window portions of a given vehicle, two, three, four (or more) masks of different shapes may be interleaved in a single strip of paper.

For the same purpose, it is also possible to use paper having substantially identical properties of absorbing liquid or pasty substances on both faces so that a single mask such as one that is suitable for a front left window can equally well be used to mask either said window or else to mask a "symmetrical" window, i.e. the front right window of the same vehicle.

Provision may also be made to include one or more masks of small dimensions such as masks for headlights, said small masks being located inside a mask of large dimensions such as a windshield mask (for the same vehicle).

The two masks can then be separated along a zone of weakness extending along the outline of the mask of small dimensions; after the two masks have been separated, the hole left in the mask of large dimensions can be used for connecting the mask to the window portion by means of adhesive tape extending some of the way into the hole; where necessary, the hole can easily be closed off using some other sheet of paper that is cut roughly to size.

In order to make it easier to separate pre-cutout masks from the strip of paper and optimize the number of masks per roll, it is preferable to use paper of weight that is less than or equal to 200 g/m$^2$, in particular less than or equal to 100 g/m$^2$, for example about 20 g/m$^2$ to 60 g/m$^2$.

In order to make the rolls easier to handle, it is preferable to use a strip of paper of width that is less than or equal to 1 meter (m), and of length less than or equal to 200 m, giving a total mass less than or equal to 20 kilograms (kg); for this purpose also, the diameter of rolls should be restricted to a maximum of about 15 centimeters (cm) to 20 cm.

In another aspect, the invention consists in providing a device for storing and dispensing precut masks in the shapes of the window portions of a plurality of motor vehicles; the device comprises a plurality of parallel bars, each of which is suitable for receiving one (or preferably more) roll(s) of paper; each roll forming a strip with a plurality of precut masks; the strip may be unwound to a length sufficient to enable a mask to be extracted therefrom by turning the roll and/or the bar supporting the roll; this can be the result of applying a traction force manually to the free end of the strip of paper.

In a preferred embodiment, the device comprises a plurality of roll-supporting bars (or shafts) which are superposed and are supported by a frame that is common to all of said bars; the spacing pitch between the bars is preferably less than or equal to 30 cm.

The invention provides a device that is compact, and simple to manufacture and to use; in order to further improve its compactness, it may have two series of superposed bars extending in two substantially vertical planes.

The bars are preferably identical in length, and of a length that enables each of them to receive a plurality of rolls side by side; it is thus possible to group together on a single bar (or on two adjacent bars) rolls that contain all of the masks needed for a particular model of vehicle, thus making it easier to identify the rolls on the storage and dispensing rack.

Other advantages and characteristics of the invention appear in the following description which refers to the accompanying drawings, and which relates to preferred embodiments of the invention without being limiting in any way.

DETAILED DESCRIPTION OF THE PRESENTLY PREFERRED EMBODIMENTS

Figures 1, 2, 3, 4, 5:
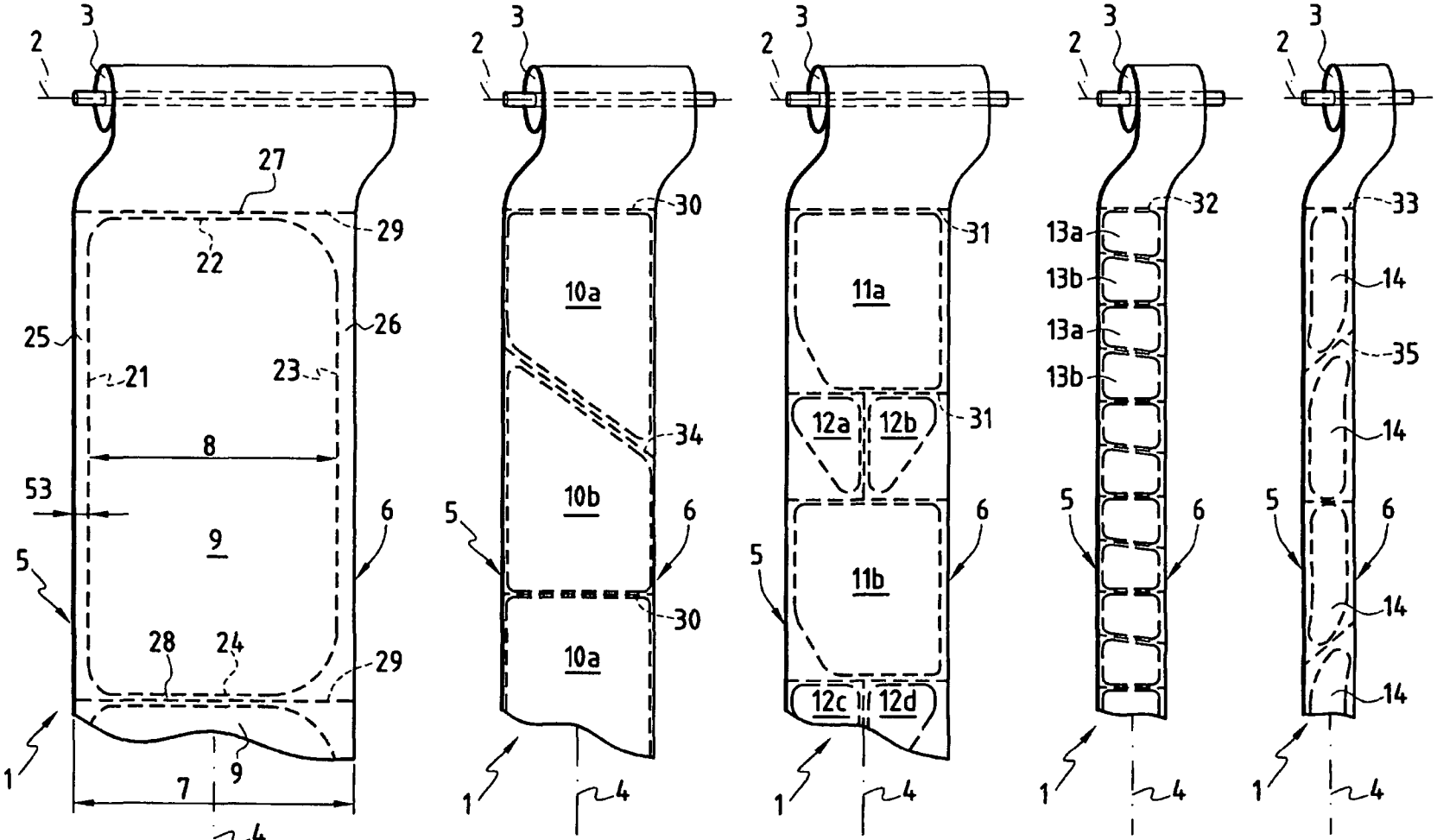
FIGS. 1 to 5 are diagrams showing five embodiments of a strip of paper including masks for window portions of different shapes.

With reference to FIGS. 1 to 5 and 8 in particular, the strip 1 of paper in which papering masks are cut out is rolled on a tubular core of axis 2 so as to form a roll 3.

The unrolled portion of the strip 1 extends along an axis 4: the side edges 5 and 6 of the strip are parallel to the axis 4; the width 7 of the strip 1 (FIG. 1) matches the width 8 of identical masks 9 precut in said strip; each mask 9 may be based on the shape of the windshield of a determined motor vehicle, and the masks 10, 11, 12, 13, and 14 that are precut in the strips of FIGS. 2 to 5 may respectively correspond to the shapes of front windows (masks 10*a*, 10*b*), of back windows (masks 11*a*, 11*b*, 12*a*, 12*b*, 12*c*, 12*d*), or the outside mirrors (13*a*, 13*b*), and of the headlight covers (14) of a given vehicle.

Figure 6:
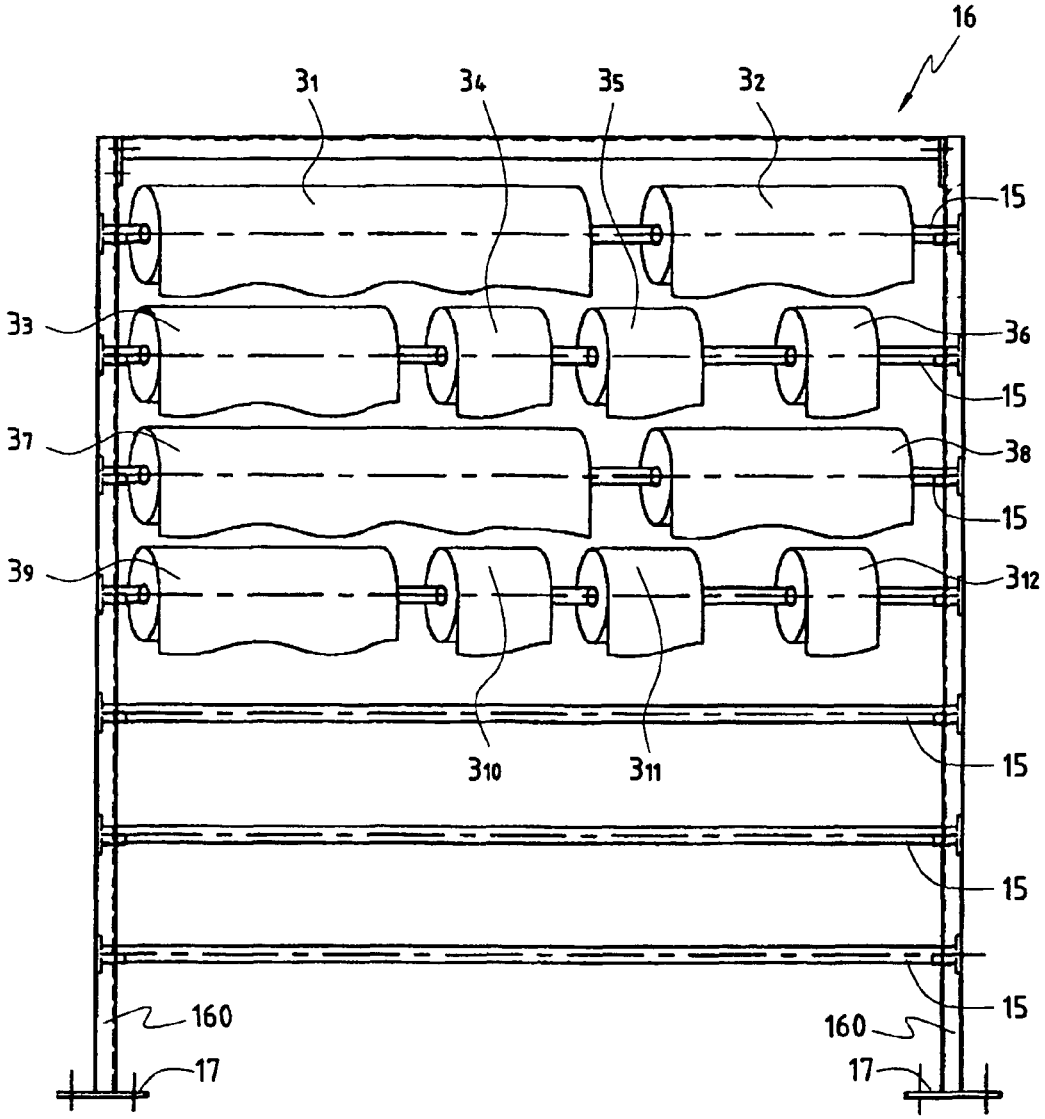
FIG. 6 is a diagrammatic front view of a device (or rack) for storing and dispensing papering masks, the rack carrying twelve rolls.

Thus, for one type or model of vehicle four to eight rolls may be provided, in particular the six rolls $\mathbf{3}_1$ to $\mathbf{3}_6$ of FIG. 6; the other six rolls $\mathbf{3}_7$ to $\mathbf{3}_{12}$ contain masks of shapes adapted to the window portions of a second type or model of vehicle; the various rolls adapted to a particular vehicle are grouped together side by side or on one or more adjacent bars 15 of the mask dispenser device 16.

Figure 7:
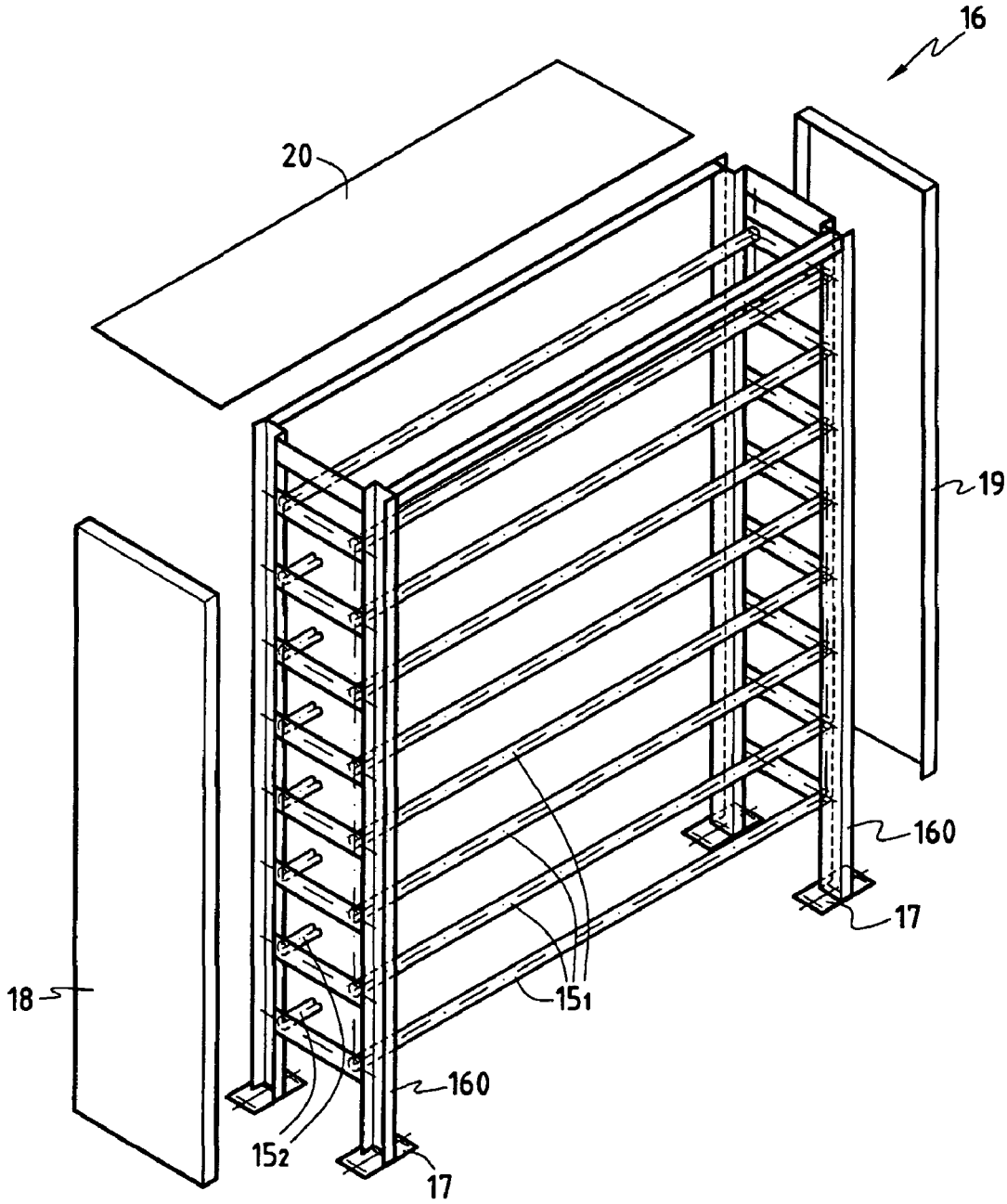
FIG. 7 is a diagrammatic exploded perspective view showing the mechanical structure of a device for storing and dispensing precut masks packaged as rolls.

The dispenser 16 shown in FIG. 7 comprises eight superposed parallel first bars $\mathbf{15}_1$ of horizontal axis extending along the front face of the dispenser, and it has eight superposed second bars $\mathbf{15}_2$ of horizontal axis extending over the rear face of the dispenser; the bars 15, $\mathbf{15}_1$, $\mathbf{15}_2$ are fixed to a frame 160 and they are regularly spaced apart along a vertical axis.

The frame stands on the ground via legs 17 and it receives side panels 18 and 19 and a top panel 20 which shelter the rolls and receive symbols specifying for the bars and/or rolls the corresponding vehicles and window portions.

The masks 9, 10, 11, and 13 are in the form of curvilinear quadrilaterals, while the masks 12*a* to 12*d*, which are of identical shape, correspond to the shape of a rear quarter window of a vehicle, being in the form of curvilinear triangles, while the headlight masks 14 are in the form of tongues.

The outline of the mask 9 is defined by four rectilinear segments 21 to 24 which are parallel in pairs and interconnected by four curvilinear segments constituting circular arcs; perforations and/or cut slits are disposed discontinuously along these segments and form a weakened outline around the mask 9, thereby making it easier to separate it from the surrounding portions of the strip of paper; these portions comprise two side margins 25 and 26 of narrow width 53, and two connection portions 27 and 28 likewise of narrow width.

The margins 25, 26 extend respectively between the edge 5 of the strip 1 and the rectilinear segment 21, and between the edge 6 of the strip 1 and the rectilinear segment 23.

Each connection portion 27, 28 extends between two consecutive masks 9 provided on the strip 1, and includes a weakened segment 29 that is perforated and/or cut in discontinuous manner, extending from one edge 5 to the other edge 6 of the strip 1 along a straight line perpendicular to said edges.

In similar manner, the strips shown in FIGS. 2 to 5 have transverse connection portions between pairs of adjacent masks, which connection portions are weakened by the presence of perforated and/or precut lines 30 to 33 which extend perpendicularly to the edges 5 and 6.

In addition, the strip shown in FIG. 2 has an oblique connection portion between two masks 10*a* and 10*b* which extend along a perforated line 34 that is oblique (relative to the edges 5 and 6); similarly, an oblique connection strip including a precut oblique line 35 separates two adjacent masks 14 that are disposed opposite ways round (FIG. 5).

Figure 8:
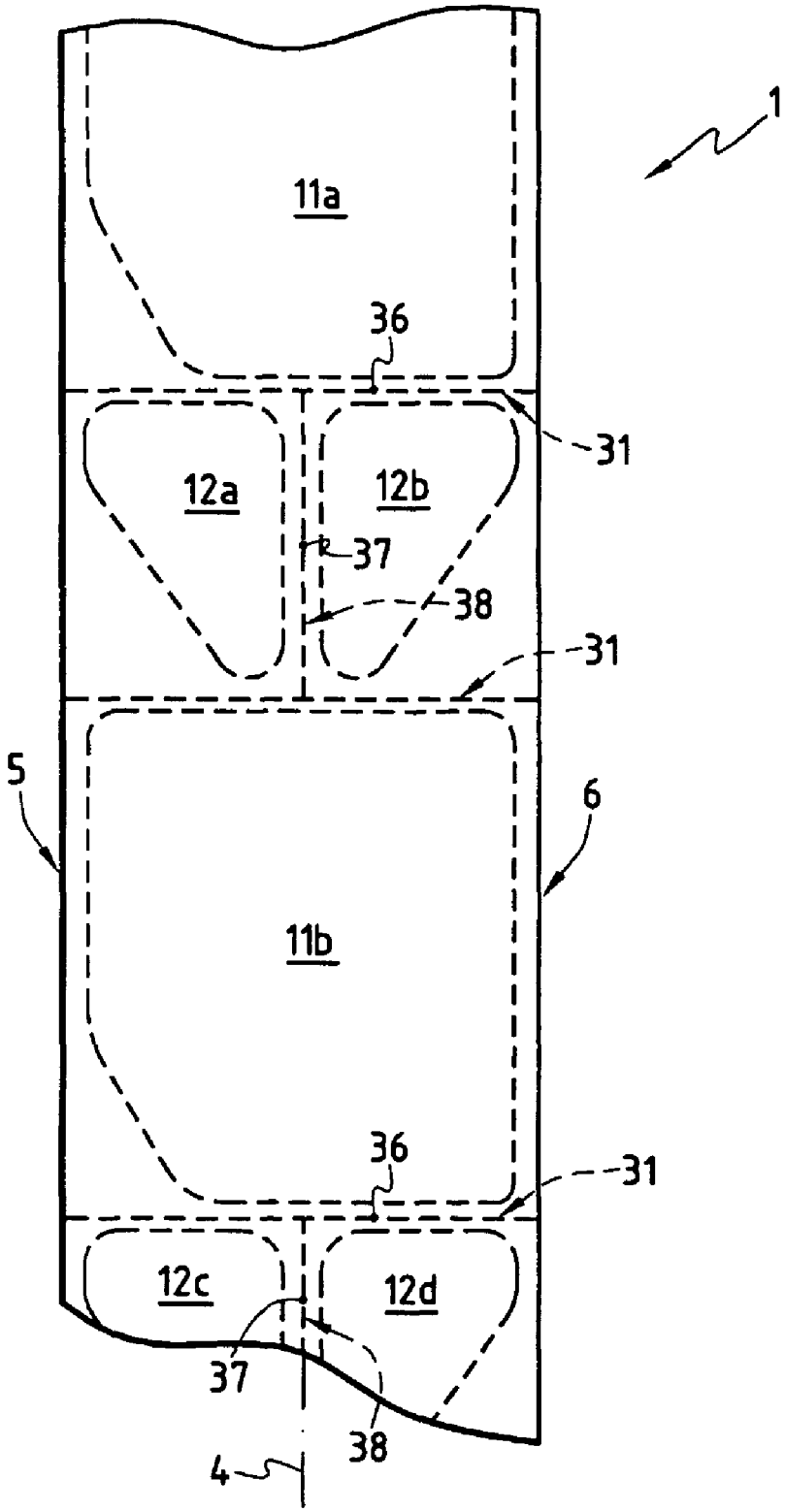
FIG. 8 shows the strip of paper of FIG. 3 on a larger scale.

In the embodiment shown in FIGS. 3 and 8, the strip 1 has a plurality of masks 11*a*, 11*b* of identical shape which are disposed in alternation with a plurality of masks 12*a*, 12*b*, 12*c*, and 12*d* likewise of identical shape, being disposed symmetrically about the axis 4, and interleaved in pairs between two successive masks 11*a* and 11*b*, with the shape of the masks 12*a* to 12*d* being different from the shape of the masks 11*a* and 11*b*.

In this embodiment, the strip has transverse connection portions 36 weakened by lines of perforations 31, together with longitudinal connection portions 37 weakened by longitudinal perforated lines 38 extending parallel to the axis 4.

Figure 9:
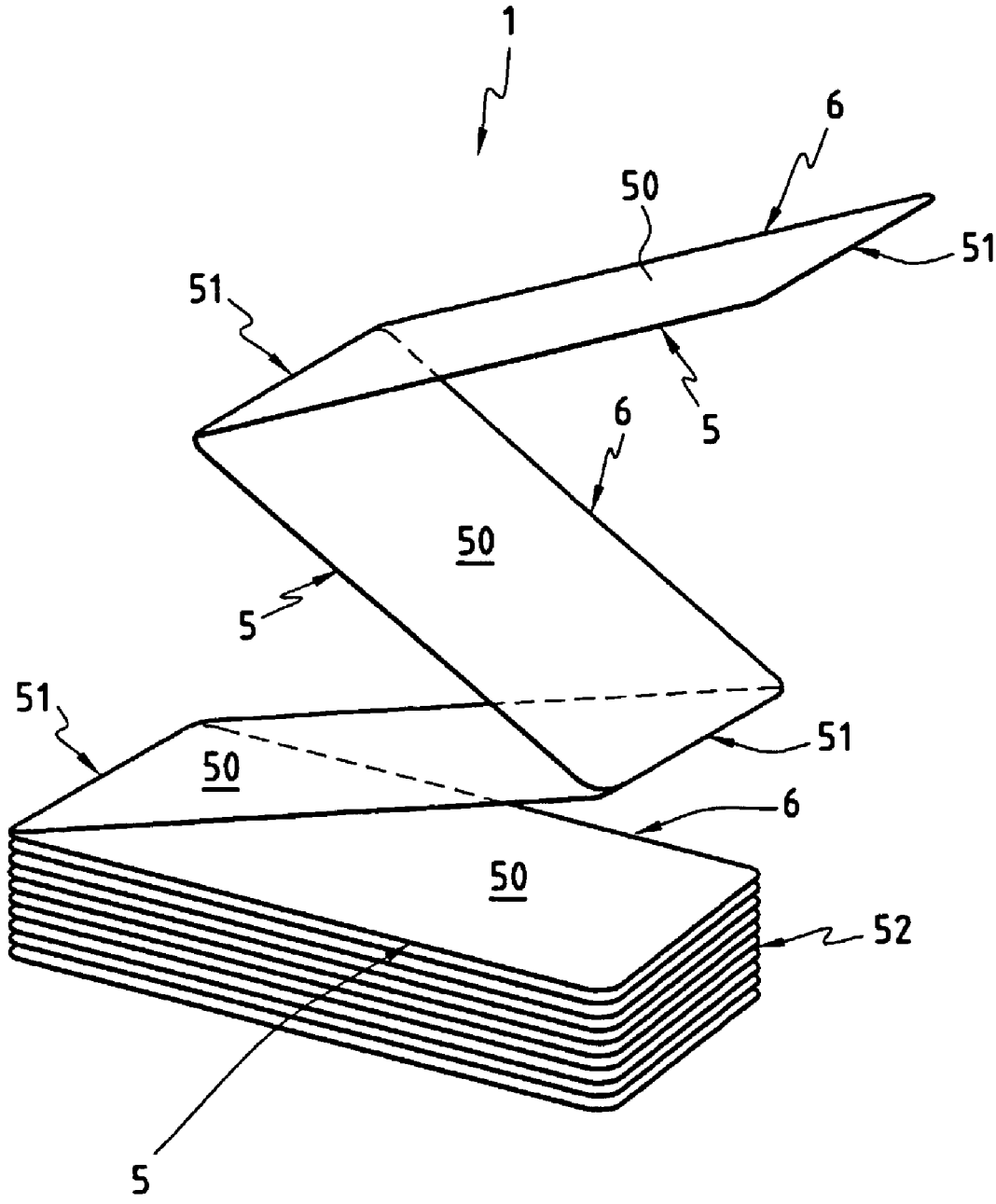
FIG. 9 is a diagrammatic perspective view showing a variant embodiment in which the strip is folded.

In the embodiment shown in FIG. 9, the strip 1 of paper is constituted solely by a plurality of masks 50 in the form of rounded rectangles; two adjacent masks are connected together via a rectilinear precut outline portion 51; thus, the strip does not have any side margins, said margins being separated from the strip during manufacture; in this embodiment, the width of the transverse connection portions 51 between two adjacent masks is zero. The strip 1 is folded along the precut lines 51 which extend perpendicularly to its edges 5 and 6, thereby forming a stack 52 of masks 50.

The strips may be constituted by paper of weight close to 40 g/m$^2$ to 45 g/m$^2$.

Figure 10:
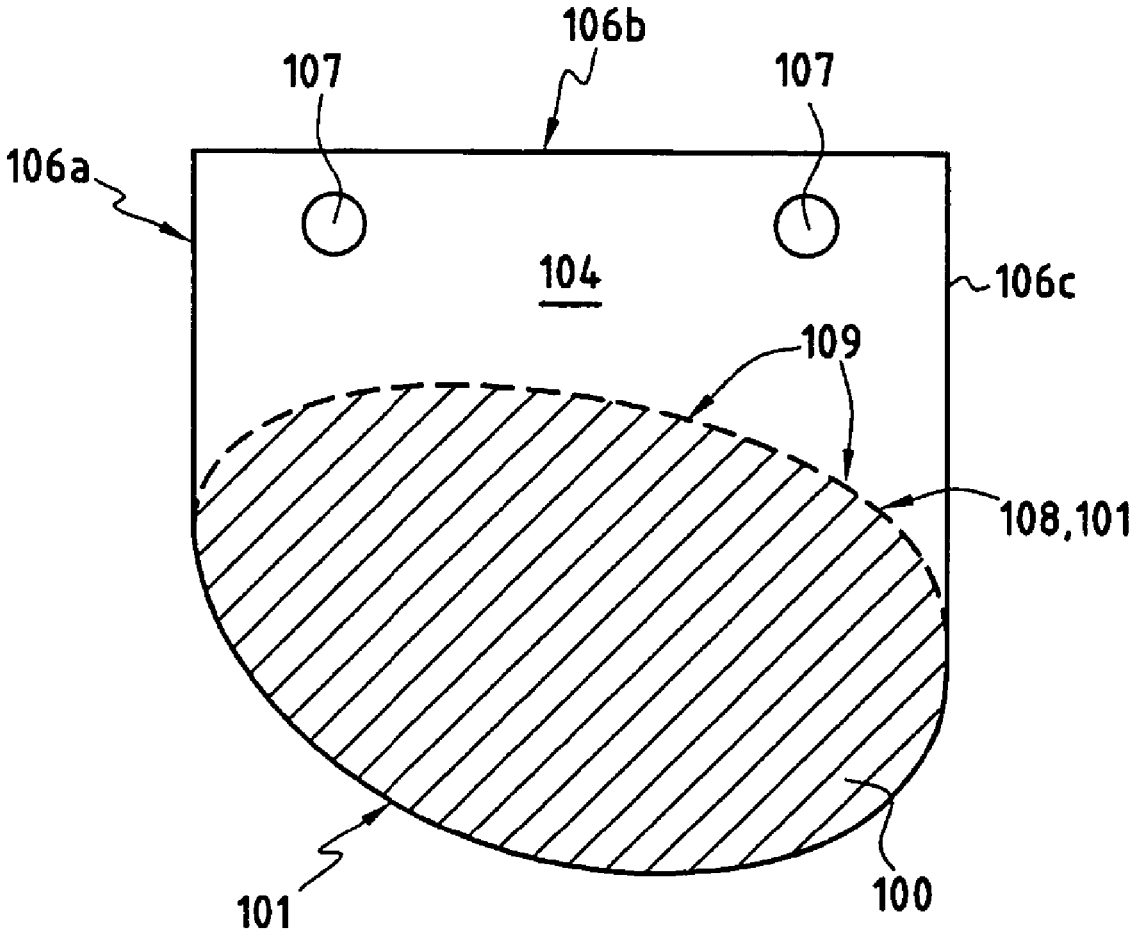
FIG. 10 is a plan view of a mask of the invention secured to an extender strip.

With reference to FIG. 10, the masks 100 whose surface is shown shaded is defined by a curvilinear outline 101 of substantially oval shape.

A portion of this outline forms a demarcation line 108 separating the mask 100 from an extender strip 104 that extends along the curved line 108.

A plurality of cutouts 109 are formed through the sheet forming the mask 100 and the strip 104, which cutouts extend along the line 108 and weaken the sheet along this line so as to make it easier to separate the strip 104 from the mask 100 along said line 108.

The strip 104 is pierced by two orifices 107 through which two mask-support rods (not shown) can extend.

In addition to the curved line 108, the strip 104 is defined by three rectilinear segments 106*a*, 106*b*, and 106*c*, thus making it easier to put the masking device 110 into abutment against a wall (not shown), by causing the edge of the sheet extending along one of these segments to press thereagainst, thus making it easier to handle, package, store, and distinguish visually between a plurality of stacked devices.

Figure 11:
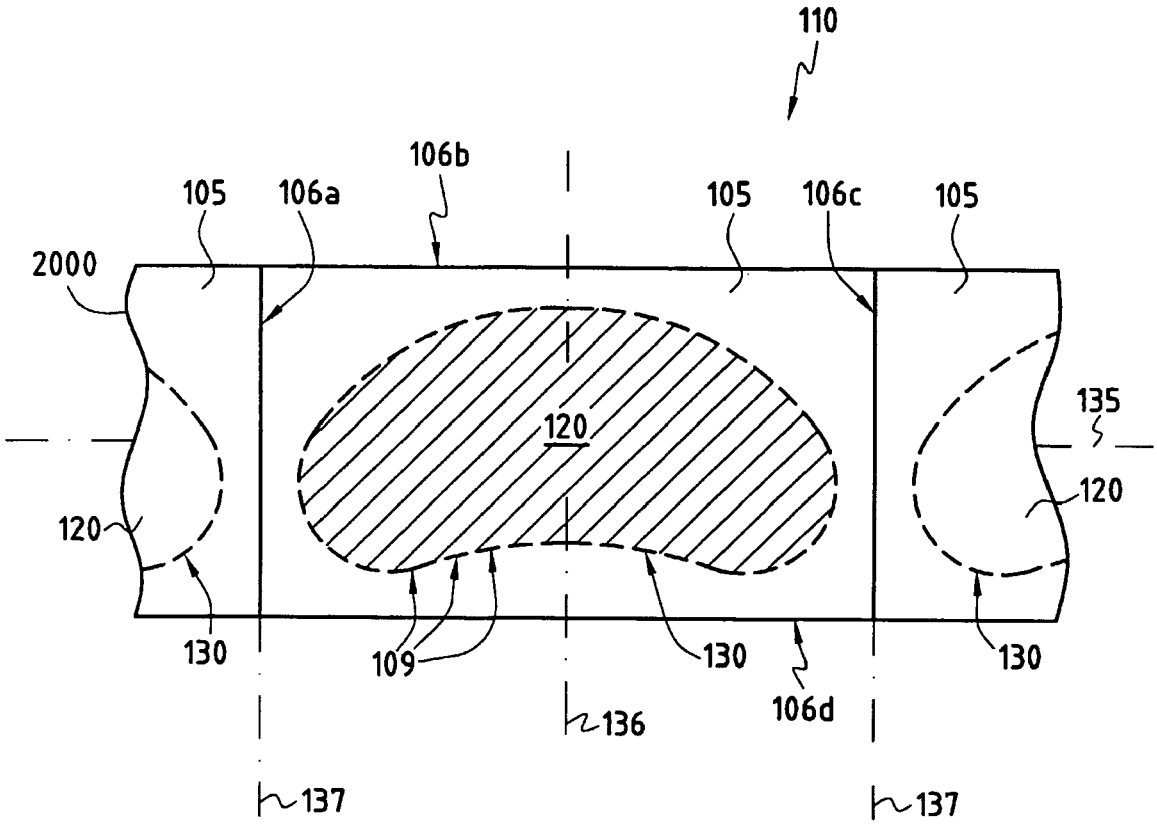
FIG. 11 is a plan view of a mask of the invention secured to an extender frame, together with a portion of the continuous strip in which the mask is incorporated.

With reference to FIG. 11, the mask 120 whose surface area is shaded is defined by a curvilinear outline 130 that is kidney-shaped.

This entire outline forms a demarcation line separating the mask 120 from an extender frame 105 which itself extends between the (inner) outline 130 and a rectangular outer outline formed by four rectilinear segments 106*a*, 106*b*, 106*c*, and 106*d*.

The outline 130 serving as a demarcation line is provided with regularly spaced-apart perforations 109.

The masking device 110 is in the form of a continuous strip 2000 of paper extending along an axis 135, with a portion thereof being shown in FIG. 11, which strip has a plurality of identical masks 120 that are regularly spaced apart along said axis, together with the same number of frames 105 extending said masks.

Each mask can be folded along a middle axis 136 when the strip 2000 is folded concertina-wise along the axes 136 and 137; the rectilinear portions 106*a* and 106*c* of the outline of the frame 105 extending along axes 137 orthogonal to the axis 135 and separating two adjacent frames are themselves preferably weakened by perforations or cutouts such as those referenced 109.

Figure 12:
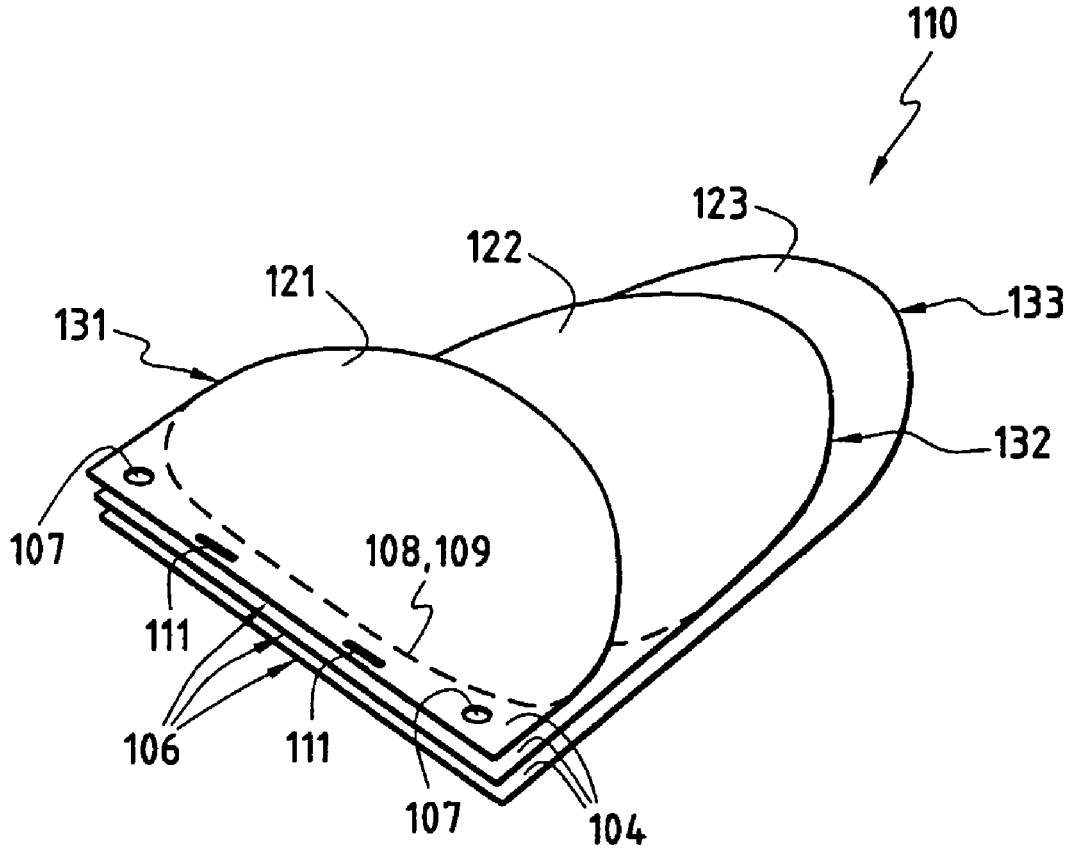
FIG. 12 is a diagrammatic perspective view of a packet combining a plurality of different masks enabling a plurality of distinct window portions of a determined model of vehicle to be hidden.

With reference to FIG. 12, a packet 110 is constituted by three masks 121, 122, and 123, which are stacked and which have respective outlines 131, 132, and 133 which are curvilinear in part.

Figure 13:
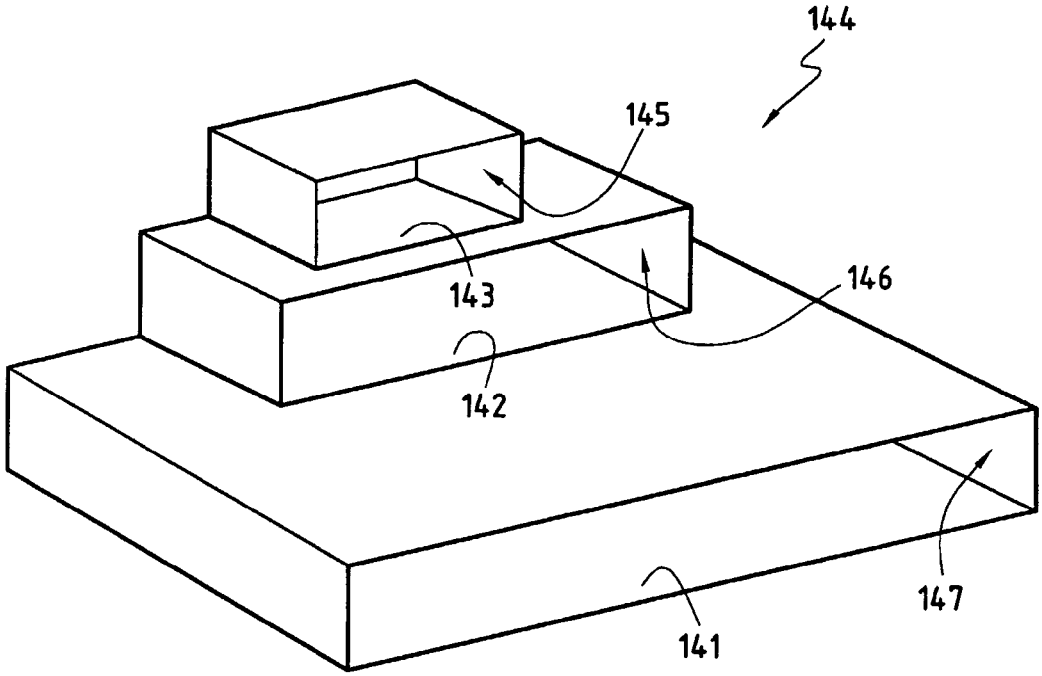
FIG. 13 is a diagrammatic perspective view of a cabinet for storing different masks.
Figure 14:
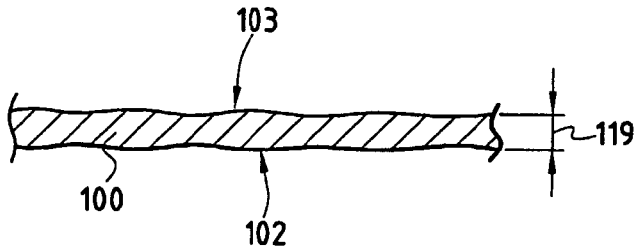
FIG. 14 is a fragmentary section view of a sheet of material suitable for use in making a mask of the invention.

Each of these masks is extended by a respective strip 104 having a rectilinear edge 106 and including two orifices 107; in order to facilitate transport and packaging, the strips 104 are united by staples 111, and the rectilinear portions 106 of their respective outlines are superposed (in vertical alignment).

Where appropriate, after the staples 111 have been removed, the masks and their associated strips can be stored flat in a vehicle repair workshop, in superposed rectangular compartments 141, 142, and 143 of a mask storage cabinet 144 (FIG. 13), the rectilinear outline portions 106 of the strips being put into abutment against a vertical side wall 145 to 147 of a respective compartment, which compartments are of shapes and dimensions that are adapted respectively to each of the masks 121 to 123.

In order to manufacture masks of the invention, it is preferable to form a stack of a plurality of sheets of said material, and then to cut through them simultaneously, preferably by means of a jet of liquid (in particular water) or by means of a laser beam, thereby cutting through a plurality of stacked sheets so as to obtain a plurality of identical masks, extended where appropriate by said strips of said extender portions; alternatively, the cutting along the outline of a mask may be performed by oxy-acetylene cutting, by punching, or by a plasma.

The invention claimed is:

1. A mask for protecting a convex or window portion of a vehicle, the mask being made of a sheet material and having an outline, the outline being curvilinear, at least in part, both faces of the sheet material presenting a high resistance to penetration by aqueous or oily substances, the weight per unit area of the sheet material lying in the range 20 g/m$^2$ to 80 g/m$^2$, the thickness of the sheet material being less than 200 μm, said mask having a detachable strip extending along a curved line, the curved line being weakened by perforations or cutouts.

2. A mask according to claim 1, in which its entire outline is curvilinear.

3. A mask according to claim 1, wherein the sheet material is selected from imitation parchment paper and Kraft paper coated with polyethylene on both faces.

4. A mask according to claim 1, which is extended along one of its curvilinear edges by a detachable extender strip or portion presenting a portion of a rectilinear outline.

5. A mask according to claim 4, in which said extender strip or portion is pierced by one or more orifices for passing one or more mask-support rods.

6. A mask for protecting a convex portion of a vehicle, the mask being made of a sheet material and having an outline, the outline being curvilinear at least in part, both faces of the sheet material presenting a high resistance to penetration by aqueous or oily substances, the weight per unit area of the sheet material lying in the range 20 g/m$^2$ to 80 g/m$^2$, the thickness of the sheet material lying in the range of 20 μm to 80 μm, whereby the outline of the mask can match accurately the outline of the convex portion after the mask has been deformed by being pressed against the convex portion, said mask having a detachable strip extending along a curved line, the curved line being weakened by perforations or cutouts.

7. The mask according to claim 6, in which its entire outline is curvilinear.

8. The mask according to claim 6, wherein the sheet material is selected from imitation parchment paper and Kraft paper coated with polyethylene on both faces.

9. The mask according to claim 6, which is extended along one of its curvilinear edges by a detachable extender strip or portion presenting a portion of a rectilinear outline.

10. The mask according to claim 9, in which said extender strip or portion is pierced by one or more orifices for passing one or more mask-support rods.

* * * * *

UNITED STATES PATENT AND TRADEMARK OFFICE

CERTIFICATE OF CORRECTION

PATENT NO. : 7,022,188 B2
DATED : April 4, 2006
INVENTOR(S) : Eric Marc Ganci

It is certified that error appears in the above-identified patent and that said Letters Patent is hereby corrected as shown below:

Title page,
Item [73], should read:
-- [73] Assignees: Denis A. Zebina, Marrakech (MA);
Eric M. Ganci, Marrakech (MA) --.

Signed and Sealed this

Thirtieth Day of May, 2006

JON W. DUDAS
*Director of the United States Patent and Trademark Office*